US006431276B1

(12) United States Patent
Robb et al.

(10) Patent No.: US 6,431,276 B1
(45) Date of Patent: Aug. 13, 2002

(54) REMOTE ACTUATED PLUG APPARATUS

(75) Inventors: Ewan O. Robb, Angus (GB); Jeffrey W. Huggins, Grapevine, TX (US); Roderick B. Falconer, Kintore (GB); Michael Gardner, Farmers Branch, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/665,046

(22) Filed: Sep. 19, 2000

Related U.S. Application Data

(62) Division of application No. 09/184,521, filed on Nov. 2, 1998, now Pat. No. 6,161,622.

(51) Int. Cl.[7] ..... E21B 23/00; E21B 33/12

(52) U.S. Cl. ..... 166/192; 166/192; 166/135; 166/317; 166/319

(58) Field of Search ..... 166/192, 135, 166/317, 319

(56) References Cited

U.S. PATENT DOCUMENTS 5,607,017 A * 3/1997 Owens et al. ..... 166/288
6,076,600 A * 6/2000 Vick, Jr. et al. ..... 166/192
6,220,350 B1 * 4/2001 Brothers et al. ..... 166/194

* cited by examiner

*Primary Examiner*—Hoang Dang
(74) *Attorney, Agent, or Firm*—William M. Imwalle; Marlin R. Smith

(57) ABSTRACT

Apparatus and associated methods are provided for remotely actuating a plug apparatus in a subterranean well. In a described embodiment, a plug apparatus has a plug member blocking fluid flow through one of two flow passages of the plug apparatus. A predetermined fluid pressure applied to one of the flow passages permits the plug member to be expended from the plug apparatus.

17 Claims, 6 Drawing Sheets

REMOTE ACTUATED PLUG APPARATUS

This is a division, of application Ser. No. 09,184,521, filed Nov. 2, 1998, now the U.S. Pat. No. 6,161,622, such prior application being incorporated by reference herein in its entirety.

BACKGROUND OF THE INVENTION

The present invention relates generally to operations performed in subterranean wells and, in an embodiment described herein, more particularly provides a remotely actuatable plug apparatus.

It is common practice for plugs in subterranean wells to be serviced via intervention into the wells. For example, a plugging device may be latched in an internal profile of a tubular string using a slickline, wireline, coiled tubing, etc. The plugging device may then be retrieved also using a slickline, wireline, coiled tubing, etc.

However, it would be more convenient, and at times less expensive, to be able to remotely actuate a plugging device. For example, instead of mobilizing a slickline, wireline or coiled tubing rig, ceasing production if necessary, and entering the tubing string with equipment for retrieving a plugging device, it would be far more convenient and economical to merely apply fluid pressure to open a plug apparatus and thereby permit fluid flow through a portion of the tubing string. It would, therefore, be desirable to provide a plug apparatus which is remotely actuated.

SUMMARY OF THE INVENTION

In carrying out the principles of the present invention, in accordance with an embodiment thereof, a remotely actuated plug apparatus is provided which permits actuation of the apparatus by application of fluid pressure thereto. Methods of using a remotely actuated plug apparatus are also provided.

In broad terms, a plug apparatus is provided which includes an expendable plug member. The plug member initially blocks fluid flow through one of two flow passages of the plug apparatus. The plug member may be expended by applying a predetermined fluid pressure to one of the two flow passages.

In one aspect of the present invention, a flow passage is isolated from fluid communication with a portion of the plug member by a fluid barrier or a flow blocking member. Application of the predetermined fluid pressure to the flow passage, or another flow passage, ruptures the fluid barrier or displaces the flow blocking member, thereby permitting fluid communication between one or both of the flow passages and the plug member portion. In various representative embodiments of the invention, the flow passages may or may not be placed in fluid communication with each other, and either of the flow passages may by placed in fluid communication with the plug member portion.

In another aspect of the present invention, fluid may be delivered to the plug member portion by a fluid source located within the well, or at the earth's surface. The fluid source may be interconnected to the plug apparatus by a line extending externally to the tubing string in which the plug apparatus is connected. The line may also extend through a well tool interconnected in the tubing string between the fluid source and the plug apparatus.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1A:
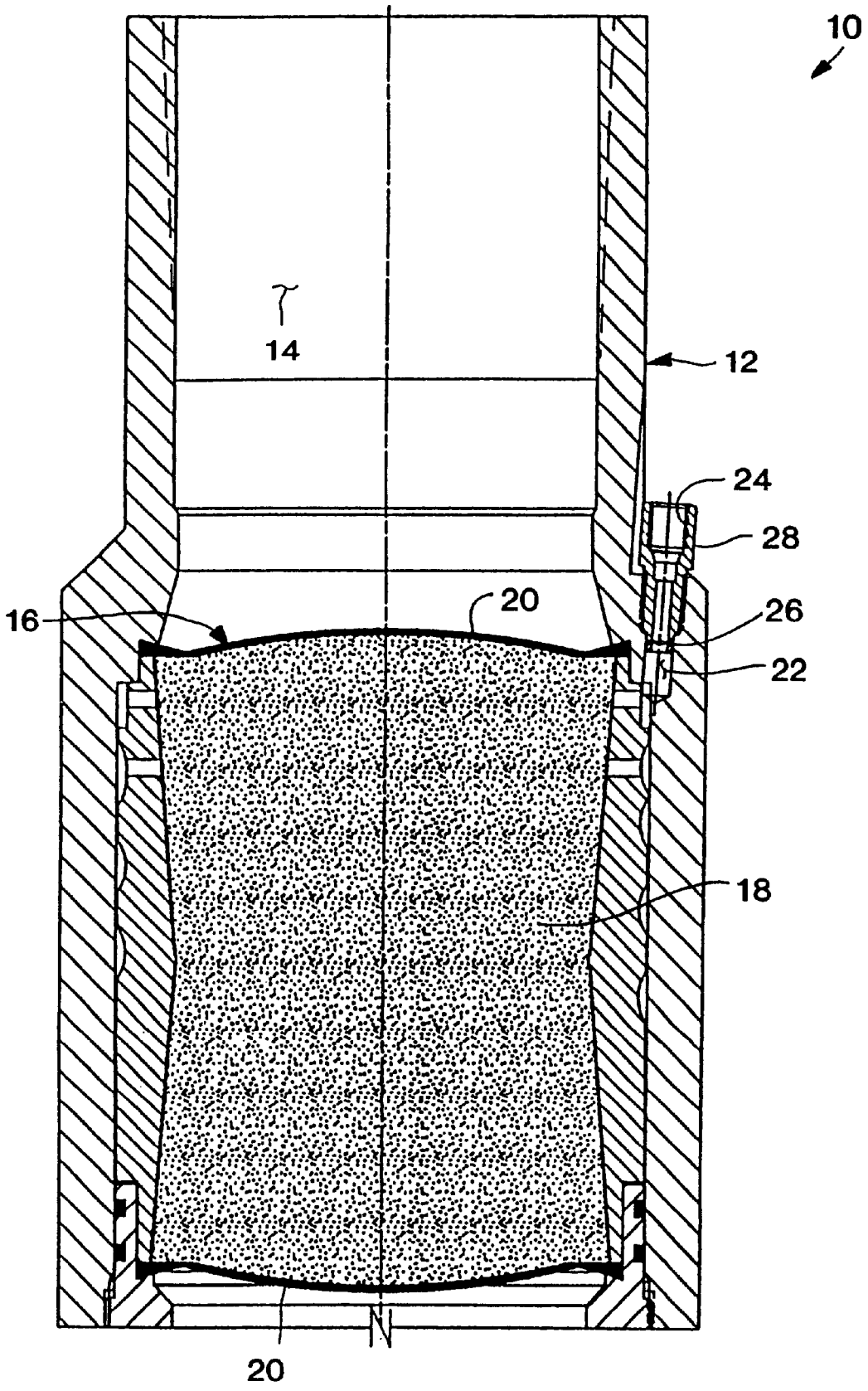
FIGS. 1A&1B are cross-sectional views of successive axial portions of a first plug apparatus embodying principles of the present invention.
Figure 1B:
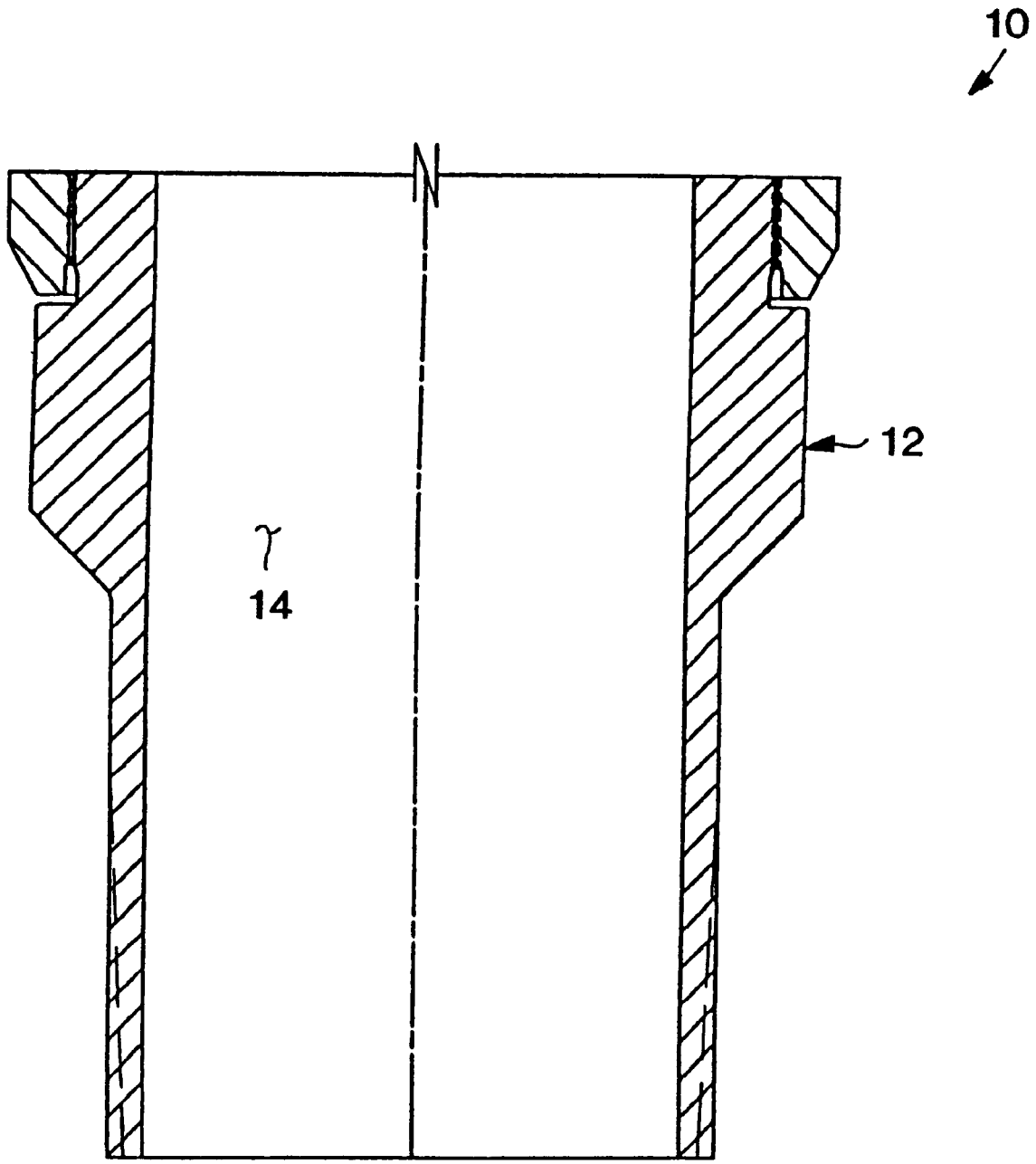

Representatively illustrated in FIGS. 1A&1B is a plug apparatus 10 which embodies principles of the present invention. In the following description of the plug apparatus 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The plug apparatus 10 is similar in some respects to plug apparatus described in U.S. Pat. Nos. 5,479,986 and 5,765,641, the disclosures of which are incorporated herein by this reference. Specifically, the plug apparatus 10 includes a generally tubular housing assembly 12 configured for interconnection in a tubing string, a flow passage 14 extending generally axially through the housing assembly, and a plug member 16 which blocks fluid flow through the flow passage, but which is expendable upon contact between a fluid and a portion 18 of the plug member. As used herein, the term "expend" means to dispense with or to make no longer functional. For example, the plug member portion 18, or a portion thereof, may be dissolvable in the fluid, may otherwise react with the fluid, etc., so that the plug member portion is no longer able to block fluid flow through the flow passage 14. In the embodiment representatively illustrated in FIGS. 1A&1B, the plug member portion 18 is a compressed mixture of salt and sand which is isolated from contact with fluid in the flow passage 14 by elastomeric end closures 20, but it is to be clearly understood that the plug member portion may be made of any other material and may be otherwise configured without departing from the principles of the present invention.

A fluid passage 22 is formed in the housing assembly 12 for providing fluid communication between a port 24 positioned externally on the housing assembly and the plug member portion 18. When fluid is delivered through the fluid passage 22 to the plug member portion 18, in a manner described more fully below, the plug member portion becomes weakened, so that the plug member 16 is no longer able to block fluid flow through the flow passage 14. A conventional rupture disk 26 or other fluid barrier may be installed between the port 24 and the fluid passage 22, so that a predetermined fluid pressure must be applied to the port 24 to rupture the rupture disk and permit fluid communication between the port and the plug member portion 18 through the fluid passage 22.

Note that the port 24 is formed in a conventional tubing connector 28 which also retains the rupture disk 26 and is threadedly installed externally in the housing assembly 12. It is to be clearly understood that the connector 28 is not necessary in a plug apparatus constructed in accordance with the principles of the present invention, for example, the port 24 could be formed directly on the housing assembly 12 and the rupture disk 26 could be eliminated or otherwise retained relative to the housing assembly.

The connector 28 is configured for connection of an external flow passage or line thereto for application of a predetermined fluid pressure to the rupture disk 26 to rupture it and deliver fluid to the plug member portion 18, as described more fully below. However, the flow passage or line could also extend internally within the housing assembly 12, or be placed in fluid communication with the fluid passage 22 via an appropriately designed connection between the plug apparatus 10 and an external fluid source. Thus, it may be readily appreciated that it is not necessary for the fluid passage 22 to be in fluid communication with a line or flow passage external to the housing assembly 12.

Figure 2A:
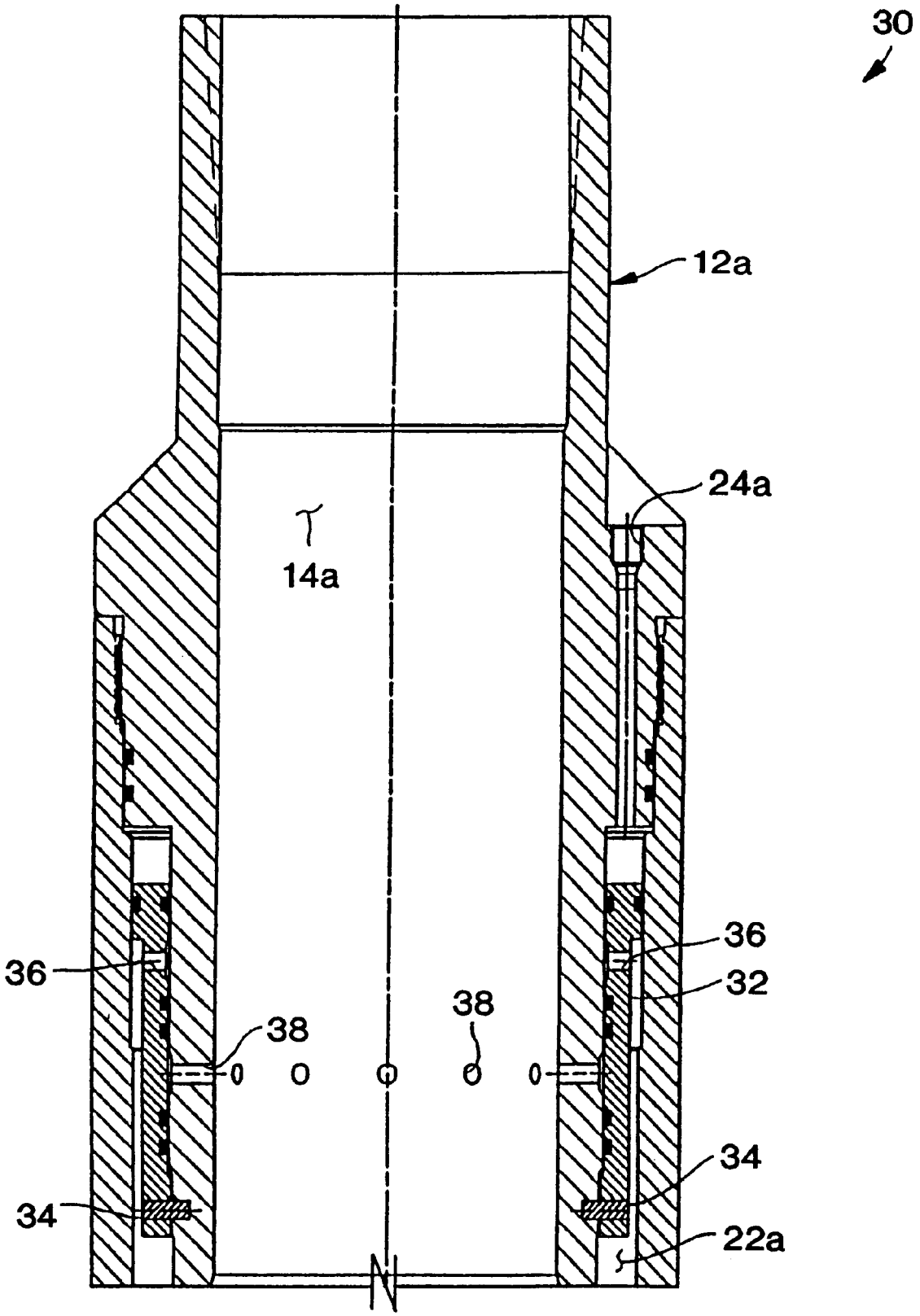
FIGS. 2A&2B are cross-sectional views of successive axial portions of a second plug apparatus embodying principles of the present invention.
Figure 2B:
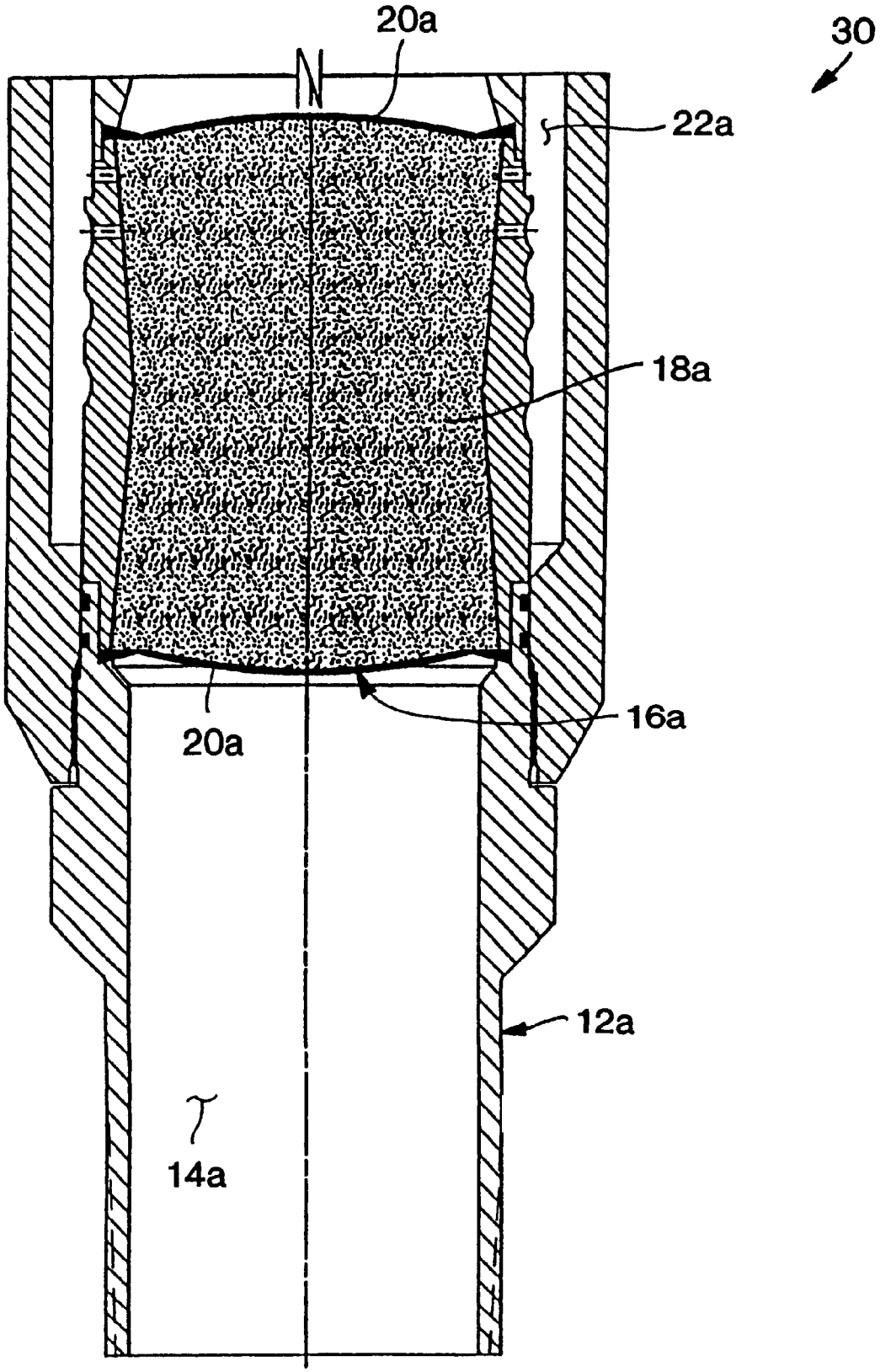

When the plug member 16 is expended, permitting fluid flow through the flow passage 14, note that the flow passage 14 will be placed in fluid communication with the fluid passage 22. This may be desirable in some instances, such as when it is desired to inject fluid into the flow passage 14 via the fluid passage 22 after the plug member 16 has been expended. A check valve (not shown) could be installed to prevent fluid flow from the flow passage 14 into the line or other flow passage connected to the port 24. However, it is not necessary for the flow passage 14 and fluid passage 22 to be placed in fluid communication after the plug member 16 is expended, in keeping with the principles of the present invention. Representatively illustrated in FIGS. 2A&2B is another plug apparatus 30 embodying principles of the present invention. Elements of the plug apparatus 30 which are similar to elements previously described are indicated in FIGS. 2A&2B using the same reference numbers, with an added suffix "a".

In the plug apparatus 30, the port 24*a* is formed directly externally in the outer housing assembly 12*a*, and no rupture disk 26 is utilized to block fluid communication between the port 24*a* and the fluid passage 22*a*. However, a tubing connector 28 could be installed in the outer housing assembly 12*a*, and a rupture disk 26 or other fluid barrier could be utilized, without departing from the principles of the present invention.

Instead of the rupture disk 26, the plug apparatus 30 utilizes a sleeve 32 sealingly and reciprocably disposed within the housing assembly 12*a* to isolate the fluid passage 22*a* from fluid delivery thereto. As viewed in FIG. 2A, the sleeve 32 is in an upwardly disposed position relative to the housing assembly 12*a*, in which the sleeve prevents fluid flow between the fluid passage 22*a* and the port 24*a*, and between the fluid passage 22*a* and the flow passage 14*a*. The sleeve 32 is releasably secured in this position by shear pins 34.

When a predetermined fluid pressure is applied to the port 24*a*, the shear pins 34 will shear, and the fluid pressure will downwardly displace the sleeve 32 relative to the housing assembly 12*a*. Such downward displacement of the sleeve 32 places openings 36 formed through the sleeve in fluid communication with openings 38 formed in the housing assembly 12*a*, thereby permitting fluid communication between the flow passage 14*a* and the fluid passage 22*a*. Fluid in the flow passage 14*a* may then flow through the openings 36, 38 and through the fluid passage 22*a* to the plug member portion 18*a*.

Note that, in the plug apparatus 30, the fluid passage 22*a* is placed in fluid communication with the flow passage 14*a* when fluid is delivered to the plug member portion 18*a*. Additionally, the port 24*a* is not placed in fluid communication with the fluid passage 22*a*. Thus, although the predetermined fluid pressure is applied to the port 24*a* to expend the plug member 16, it is the flow passage 14*a* which is placed in fluid communication with the plug member portion 18*a*. However, the port 24*a* could be placed in fluid communication with the flow passage 14*a* and/or fluid passage 22*a* without departing from the principles of the present invention. For example, one or more seals providing sealing engagement between the sleeve 32 and the housing assembly 12*a* could be disengaged from sealing engagement with the sleeve and/or the housing assembly when the sleeve 32 is displaced downwardly.

Figure 3A:
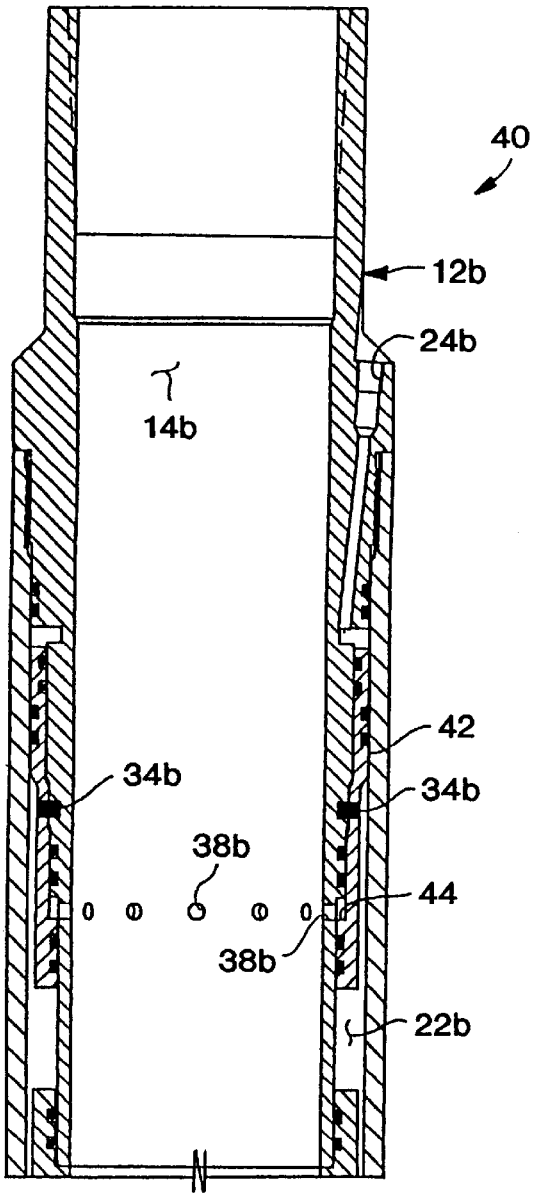
FIGS. 3A&3B are cross-sectional views of successive axial portions of a third plug apparatus embodying principles of the present invention.
Figure 3B:
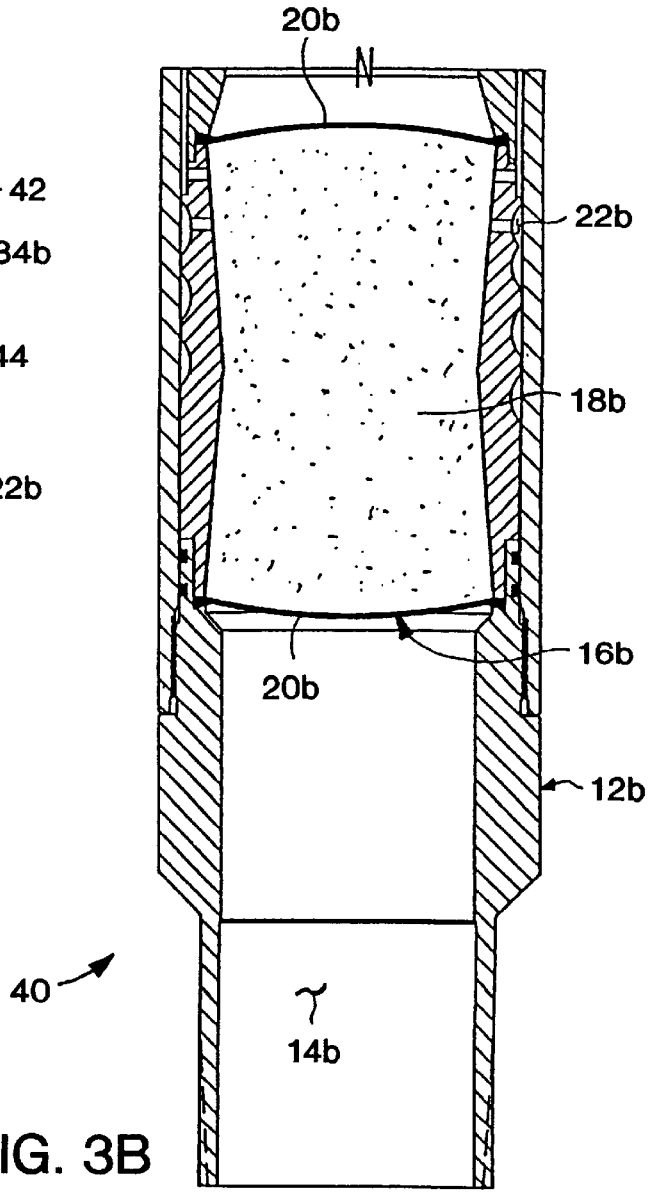

Referring additionally now to FIGS. 3A&3B, a plug apparatus 40 embodying principles of the present invention is representatively illustrated. Elements of the plug apparatus 40 which are similar to elements previously described are indicated in FIGS. 3A&3B using the same reference numbers, with an added suffix "b".

The plug apparatus 40 is similar in many respects to the plug apparatus 30 described above, in that a predetermined fluid pressure may be applied to the port 24*b* to shear the shear pins 34*b* and thereby downwardly displace a sleeve 42 within the housing assembly 12*b*, permitting fluid communication between the flow passage 14*b* and the fluid passage 22*b*. However, in the plug apparatus 40, a predetermined fluid pressure may also be applied to the flow passage 14*b* to shear the shear pins 34*b* and downwardly displace the sleeve 42.

Note that the sleeve 42 of the plug apparatus 40, unlike the sleeve 32 of the plug apparatus 30, presents an upwardly facing piston area 44 in fluid communication with the openings 38*b*. Thus, when fluid pressure is applied to the flow passage 14*b*, that fluid pressure also biases the sleeve 42 downward. The predetermined fluid pressure which may be applied to the flow passage 14*b* to shear the shear pins 34*b* may be the same as, or different from, the predetermined fluid pressure which may be applied to the port 24*b* to shear the shear pins, depending upon the respective piston areas on the sleeve 42.

When a predetermined fluid pressure is applied to the port 24*b* or flow passage 14*b*, the shear pins 34*b* will shear, and the fluid pressure will downwardly displace the sleeve 42 relative to the housing assembly 12*b*. Such downward displacement of the sleeve 42 places the openings formed through the sleeve in which the shear pins 34*b* are installed in fluid communication with the openings 38*b*, thereby permitting fluid communication between the flow passage 14*b* and the fluid passage 22*b*. Fluid in the flow passage 14*b* may then flow through the openings 38*b* and through the fluid passage 22*b* to the plug member portion 18*b*.

Note that, in the plug apparatus 40, the fluid passage 22*b* is placed in fluid communication with the flow passage 14*b* after fluid is delivered to the plug member portion 18*b*. Additionally, the port 24*b* is not placed in fluid communication with the fluid passage 22*b*. Thus, although a predetermined fluid pressure is applied to the port 24*b* or the flow passage 14*b* to expend the plug member 16*b*, it is the flow passage 14*b* which is placed in fluid communication with the plug member portion 18*b*. However, the port 24*b* could be placed in fluid communication with the flow passage 14*b* and/or fluid passage 22*b* without departing from the principles of the present invention. For example, one or more seals providing sealing engagement between the sleeve 42 and the housing assembly 12*b* could be disengaged from sealing engagement with the sleeve and/or the housing assembly when the sleeve 42 is displaced downwardly.

Figure 4:
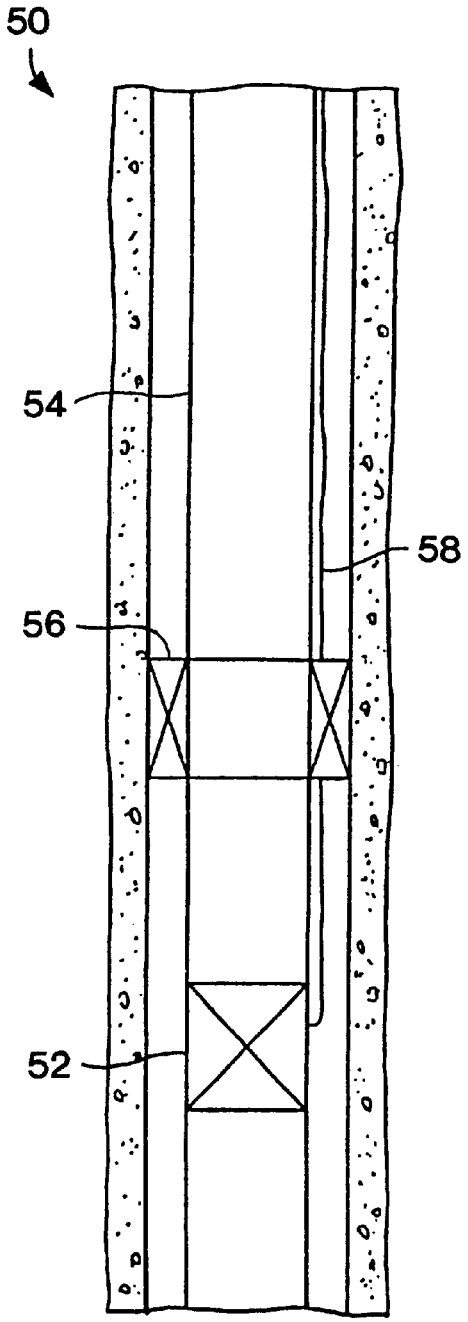
FIG. 4 is a schematicized view of a first method of using a remote actuated plug apparatus, the method embodying principles of the present invention.

Referring additionally now to FIG. 4, a method 50 of utilizing a remote actuated plug apparatus is representatively illustrated. In the method 50, a remote actuated plug apparatus 52 is interconnected as a part of a tubular string 54 installed in a subterranean well. The plug apparatus 52 may be similar to one of the above-described plug apparatus 10, 30, 40, or it may be another type of remote actuated plug apparatus.

Another well tool 56 may be interconnected in the tubular string 54. In the method 50 as depicted in FIG. 4, the well tool 56 is a hydraulically settable packer of the type well known to those skilled in the art. The packer 56 is positioned between the plug apparatus 52 and the earth's surface. It is to be clearly understood, however, that the well tool 56 may be a tool or item of equipment other than a packer, and it may be otherwise positioned in the well, without departing from the principles of the present invention.

A control line or other type of flow passage 58 is connected to a conventional fluid source, such as a pump (not shown), at the earth's surface. The term "fluid source" as used herein means a device or apparatus which forcibly transmits fluid, such as a pump, a pressurized accumulator or another fluid pressurizing device. The line 58 extends downwardly from the earth's surface, extends through the packer 56, and connects externally to the plug apparatus 52, such as at the ports 24, 24*a*, 24*b* described above. Of course, the line 58 or other type of flow passage could be internally disposed relative to the tubular string 54, could be formed in a sidewall of the tubular string, etc., without departing from the principles of the present invention. For example, in the packer 56, the flow passage 58 could be formed in a sidewall of a mandrel of the packer.

With the plug apparatus 52 initially preventing fluid flow through the tubular string 54, fluid pressure may be applied to the tubular string to set the packer 56 in the well, and then fluid pressure may be applied to the line 58 to open the plug apparatus to fluid flow therethrough. If the plug apparatus 52, like the plug apparatus 40 described above, is actuatable by application of fluid pressure to the tubular string 54, the line 58 may not be necessary, and the plug apparatus may be set up so that the predetermined fluid pressure needed to open the plug apparatus is greater than the fluid pressure needed to set the packer 56. Alternatively, the packer 56 could be settable by application of fluid pressure to the line 58, and the plug apparatus 56 could be actuated by application of fluid pressure to the line greater than that needed to set the packer. As another alternative, the packer 56 could be settable by fluid pressure in the line 58, and the plug apparatus 52 could be actuatable by fluid pressure in the tubular string 54. Thus, it will be readily appreciated that the plug apparatus 52 permits increased versatility in wellsite operations, without requiring intervention into the well for its actuation.

Figure 5:
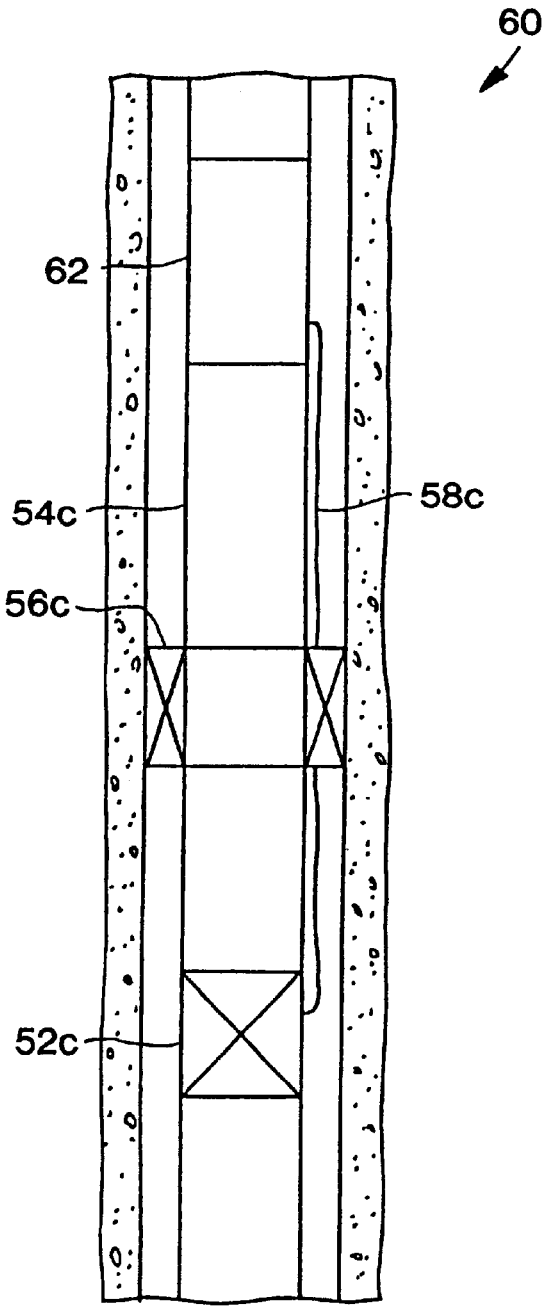
FIG. 5 is a schematicized view of a second method of using a remote actuated plug apparatus, the method embodying principles of the present invention.

Referring additionally now to FIG. 5, another method 60 embodying principles of the present invention is representatively illustrated. Elements shown in FIG. 5 which are similar to elements previously described are indicated in FIG. 5 using the same reference numbers, with an added suffix "c".

Note that, in the method 60, the line 58*c* does not extend to a fluid source at the earth's surface. Instead, the line 58*c* extends to a fluid source 62 installed in the well as a part of the tubular string 54*c*. The fluid source 62 may be a pump, hydraulic accumulator or differential pressure-driven piston of the type well known to those skilled in the art. Additionally, the fluid source 62 may apply fluid pressure to the line 58*c* in response to receipt of a signal transmitted thereto from the earth's surface or other remote location, such as another location within the well.

The fluid source 62 could include a pump or other fluid pressurizing device coupled with the tubular string 54*c* for supplying the predetermined fluid pressure to actuate the plug apparatus 52*c*. For example, a slickline, wireline, coiled tubing, or otherwise-conveyable fluid pressurizing device could be positioned in the tubular string 54*c* and coupled therewith. An example of such a fluid pressurizing device is described in U.S. Pat. No. 5,492,173. Another fluid pressurizing device is the model DPU available from Halliburton Energy Services, Inc. of Dallas, Tex. The DPU or other fluid pressurizing device may be engaged with the tubular string 54*c*, such as via an internal latching profile, to form the fluid source 62 and to place the DPU in fluid communication with the line 58*c*. The DPU could then be actuated to provide pressurized fluid, which is then delivered to the plug apparatus 52*c* via the line 58*c*.

Of course, many modifications, additions, deletions, substitutions and other changes may be made to the various embodiments of the present invention described herein, which would be obvious to a person skilled in the art, and these changes are contemplated by the principles of the present invention. For example, in the method 60, the fluid source 62 could be positioned between the packer 56*c* and the plug apparatus 52*c*, and could be attached directly to the plug apparatus. Accordingly, the foregoing detailed description is to be clearly understood as being given by way of illustration and example only, the spirit and scope of the present invention being limited solely by the appended claims.

What is claimed is:

1. A remotely actuatable plug apparatus, comprising:

an expendable plug member blocking fluid flow through a first fluid passage formed through the plug apparatus, the plug member being expendable upon contact between a portion of the plug member and a fluid; and a second fluid passage formed in the plug apparatus, the second fluid passage being fluid communicable with the plug member portion, and the second fluid passage being isolated from fluid pressure communication with the first fluid passage and all portions of the plug member at least prior to expending the plug member.

2. The plug apparatus according to claim 1, wherein the second fluid passage is selectively communicable with the plug member portion upon application of a predetermined fluid pressure to the second fluid passage.

3. The plug apparatus according to claim 2, further comprising a fluid barrier preventing fluid communication between the second fluid passage and the plug member portion, the fluid barrier permitting fluid communication between the second fluid passage and the plug member portion upon application of the predetermined fluid pressure to the second fluid passage.

4. The plug apparatus according to claim 2, further comprising a flow blocking member preventing fluid communication between the second fluid passage and the plug member portion, the flow blocking member permitting fluid communication between the second fluid passage and the plug member portion upon application of the predetermined fluid pressure to the second fluid passage.

5. The plug apparatus according to claim 2, further comprising a flow blocking member preventing fluid communication between the second fluid passage and the plug member portion, the flow blocking member permitting fluid communication between the second fluid passage and the plug member portion upon application of the predetermined fluid pressure to the first fluid passage.

6. The plug apparatus according to claim 1, further comprising a flow blocking member preventing fluid communication between the first fluid passage and the plug member portion, the flow blocking member permitting fluid communication between the first fluid passage and the plug member portion upon application of a predetermined fluid pressure to the first fluid passage.

7. The apparatus according to claim 1, wherein the second fluid passage is in fluid communication with the plug member portion, and further comprising a flow blocking device preventing fluid communication between the first and second flow passages, the flow blocking device being remotely actuatable to permit fluid communication between the first and second flow passages.

8. A remotely actuatable plug apparatus, comprising:

an expendable plug member blocking fluid flow through a first fluid passage formed through the plug apparatus, the plug member being expendable upon contact between a portion of the plug member and a fluid; and a second fluid passage formed in the plug apparatus, the second fluid passage being fluid communicable with the plug member portion, and the second fluid passage being isolated from fluid communication with the first fluid passage at least prior to expending the plug member, the first fluid passage being selectively communicable with the plug member portion upon application of a predetermined fluid pressure to the second fluid passage.

9. The plug apparatus according to claim 8, further comprising a flow blocking member preventing fluid communication between the first fluid passage and the plug member portion, the flow blocking member permitting fluid communication between the first fluid passage and the plug member portion upon application of the predetermined fluid pressure to the second fluid passage.

10. A remotely actuatable plug apparatus, comprising:

a housing assembly having a first fluid passage extending therethrough;

an expendable plug member preventing fluid flow through the first fluid passage, the plug member being expendable upon flowing of a fluid into the plug member; and a second fluid passage, the interior of the plug member being placed in fluid communication with one of the first and second fluid passages in response to application of a predetermined fluid pressure to the second fluid passage, the second fluid passage being isolated from fluid pressure communication with the first fluid passage and all portions of the plug member at least prior to expending the plug member.

11. A remotely actuatable plug apparatus, comprising:

a housing assembly having a first fluid passage extending therethrough;

an expendable plug member preventing fluid flow through the first fluid passage, the plug member being expendable upon flowing of a fluid into the plug member; and a second fluid passage, the interior of the plug member being placed in fluid communication with one of the first and second fluid passages in response to application of a predetermined fluid pressure to the second fluid passage, the second fluid passage including a port formed exteriorly on the housing assembly.

12. The plug apparatus according to claim 11, further comprising a fluid barrier preventing fluid communication between the port and the interior of the plug member.

13. The plug apparatus according to claim 12, wherein the fluid barrier is rupturable by application of the predetermined fluid pressure to the port.

14. The plug apparatus according to claim 11, further comprising a flow blocking member preventing fluid communication between the interior of the plug member and each of the port and the first fluid passage.

15. The plug apparatus according to claim 14, wherein the blocking member is displaceable by application of the predetermined fluid pressure to the port, thereby placing the interior of the plug member in fluid communication with one of the port and the first fluid passage.

16. A remotely actuatable plug apparatus, comprising:

a housing assembly having a first fluid passage extending therethrough;

an expendable plug member preventing fluid flow through the first fluid passage, the plug member being expendable upon flowing of a fluid into the plug member; and a second fluid passage isolated from all portions of the plug member, the interior of the plug member being placed in fluid communication with one of the first and second fluid in response to application of a predetermined fluid pressure to the second fluid passage, the first fluid passage being isolated from fluid communication with the second fluid passage upon application of the predetermined fluid pressure to the second fluid passage.

17. A remotely actuatable plug apparatus, comprising:

a housing assembly having a first fluid passage extending therethrough;

an expendable plug member preventing fluid flow through the first fluid passage, the plug member being expendable upon flowing of a fluid into the plug member; and a second fluid passage isolated from all portions of the plug member, the interior of the plug member being placed in fluid communication with one of the first and second fluid passages in response to application of a predetermined fluid pressure to the second fluid passage, the first fluid passage being placed in fluid communication with the second fluid passage upon application of the predetermined fluid pressure to the second fluid passage.

* * * * *